US005197850A

United States Patent [19]

Shinobu et al.

[11] Patent Number: 5,197,850

[45] Date of Patent: Mar. 30, 1993

[54] CROSS FLOW FAN SYSTEM

[75] Inventors: Yoshiharu Shinobu, Kashiharashi; Akira Takushima, Kitakatsuragi, both of Japan

[73] Assignee: Sharp Kabushiki Kaisha, Osaka, Japan

[21] Appl. No.: 816,259

[22] Filed: Jan. 3, 1992

Related U.S. Application Data

[62] Division of Ser. No. 676,354, Mar. 28, 1991, abandoned, which is a division of Ser. No. 390,833, Aug. 8, 1989, Pat. No. 5,056,987, which is a division of Ser. No. 150,390, Jan. 29, 1988, Pat. No. 4,913,622.

[30] Foreign Application Priority Data

| | | | |
|---|---|---|---|
| Jan. 30, 1987 | [JP] | Japan | 62-20890 |
| Mar. 10, 1987 | [JP] | Japan | 62-54693 |
| Mar. 10, 1987 | [JP] | Japan | 62-55067 |
| Oct. 20, 1987 | [JP] | Japan | 62-160608[U] |

[51] Int. Cl.[5] ..... F04D 5/00

[52] U.S. Cl. ..... 415/53.1; 415/53.3

[58] Field of Search ..... 415/52.1, 53.1, 53.3

[56] References Cited

U.S. PATENT DOCUMENTS

| | | | |
|---|---|---|---|
| 1,823,579 | 9/1931 | Anderson . | |
| 1,920,952 | 8/1933 | Anderson | 415/151 |
| 3,124,301 | 3/1964 | Helmbold | 415/53.2 |
| 3,209,668 | 10/1965 | Haerter | 415/53.1 |
| 3,209,989 | 10/1965 | Eck | 415/53.3 |
| 3,249,292 | 5/1966 | Eck et al. | 415/53.1 |
| 3,258,195 | 6/1966 | Laing | 415/53.3 |
| 3,306,526 | 2/1967 | Laing | 415/53.3 |
| 3,322,332 | 5/1967 | Laing | 415/53.3 |
| 3,398,882 | 8/1968 | Zenkner | 415/53.1 |
| 3,441,201 | 4/1969 | Hollenberg | 415/53.3 |
| 3,459,365 | 8/1969 | Glucksman et al. | 415/53.1 |
| 3,460,647 | 8/1969 | Laing | 415/53.3 |
| 3,522,994 | 8/1970 | Zenkner | 415/53.1 |
| 4,014,625 | 3/1977 | Yamamoto | 415/53.1 |
| 4,025,223 | 5/1977 | Anders et al. | 415/53.1 |
| 4,078,870 | 3/1978 | Keller et al. | 415/53.1 |
| 4,279,569 | 7/1981 | Harloff | 415/53.3 |
| 4,462,750 | 7/1984 | Sugawara et al. | 415/53.3 |
| 4,705,453 | 11/1987 | Hopfensperger | 415/53.1 |
| 4,712,976 | 12/1987 | Hopfensperger et al. | 415/53.1 |
| 4,913,622 | 4/1990 | Tanaka et al. | 415/53.3 |
| 4,958,504 | 9/1990 | Ichikawa et al. | 415/53.3 |
| 5,056,987 | 10/1991 | Tanaka et al. | 415/53.3 |
| 5,127,238 | 7/1992 | Ichikawa et al. | 415/53.3 |

FOREIGN PATENT DOCUMENTS

| | | | |
|---|---|---|---|
| 0056483 | 7/1982 | European Pat. Off. . | |
| 1403545 | 11/1968 | Fed. Rep. of Germany . | |
| 2364781 | 7/1974 | Fed. Rep. of Germany . | |
| 2545036 | 4/1977 | Fed. Rep. of Germany . | |
| 1446638 | 6/1966 | France . | |
| 91795 | 7/1980 | Japan | 415/53.3 |
| 67994 | 4/1983 | Japan | 415/53.3 |
| 67995 | 4/1983 | Japan | 415/53.3 |
| 128495 | 8/1983 | Japan | 415/53.3 |
| 37274 | 2/1984 | Japan | 415/53.3 |
| 129599 | 6/1987 | Japan | 415/53.1 |
| 901642 | 1/1982 | U.S.S.R. . | |
| 988712 | 4/1965 | United Kingdom . | |
| 1066053 | 4/1967 | United Kingdom . | |
| 1136981 | 12/1968 | United Kingdom . | |

*Primary Examiner*—John T. Kwon

[57] ABSTRACT

In a cross flow type fan according to the present invention having a tongue section provided between the rear guide surrounding the cross flow fan, the back side and bottom side thereof and the front side of the fan, a projecting section (flow changing board) is provided on the rear guider, the shape of the tongue section is caused to be different at the middle section and at both ends of the axial direction of the fan, the boundary section of the suction opening and the discharge opening of the air is divided on the outward circumferential surface of the fan by the partition wall having continuous through holes, and the air flow direction control blade being curved toward the discharge side is provided.

20 Claims, 16 Drawing Sheets

CROSS FLOW FAN SYSTEM

This application is a divisional of copending application Ser. No. 07/676,354 filed on Mar. 28, 1991 now abandoned which is a Rule 60 divisional application of Ser. No. 07/390,833, filed on Aug. 8, 1989, now U.S. Pat. No. 5,056,987, which is a Rule 60 divisional of application Ser. No. 07/150,390 filed Jan. 29, 1988, now U.S. Pat. No. 4,913,622, the entire contents of which are hereby incorporated by reference.

BACKGROUND OF THE INVENTION

The present invention relates to a cross flow fan system which is utilized for air conditioners and various other types of air conditioning systems.

Example 1 of the conventional cross flow fan:

The cross flow fan used in a conventional air conditioner is equipped with a suction opening a for air and a discharge opening 2 as shown in FIG. 4, has a heat exchanger 5 and a cross flow fan 4 in the casing, and a tongue section 3 and a rear guider 6 for stabilizing the air flow. In a construction of a conventional cross flow fan such as this, in order to reduce the depth of the casing, the heat exchanger 5 is installed so that the lower end of the heat exchanger 5 is above the shaft of the fan.

With the above construction for a cross flow fan, the direction of the air flowing into the cross flow fan 4 is brought close to the vertical direction as shown by the actual line 9. The vortex flow above the part 7 where the rear guider 6 and the outer circumferential surface of the fan are closest becomes difficult to generate. On the other hand, air which does not flow into the cross flow fan 4 from the part 7 increase as shown by the broken line flows directly into the discharging direction along the rear guider 6, resulting in a deterioration of discharged air volume and in noise characteristic.

Example 2 of the conventional cross flow fan:

FIG. 6 is a structural diagram of a cross flow fan for a conventional air conditioner. As shown in FIG. 6, the conventional cross flow fan incorporates a cross flow fan 101 in a casing 103, and at a position close to the outer circumferential surface of the fan, a tongue section 102 is provided having the same cross section (which plays a role of dividing the suction side and discharge side) in an overall area in the direction of the shaft of the fan. Incidentally, 104 represents a discharge opening.

In this case, the discharge flow rate at both ends 104*a* of the fan shown in FIG. 7 is less than that of the middle section 104*b* of the same fan. There is a possibility of generating a reverse suction flow depending on the shape of the tongue section 102, causing instability in the discharge flow rate of the fan. Furthermore, if a load 105 such as a heat exchanger is provided on the suction side of the fan, there is a possibility to easily generate surging of the discharged air flow particularly in the low air volume range.

In order to solve the above mentioned problems, there has been an attempt to stabilize the discharged air flow at both ends 104*a* of the fan by providing from the side plate a protruding portion (projection) 108 as shown by oblique lines on both ends 104*a* of the discharge opening. By using this method, the discharge flow rate of both ends 104*a* of the fan increases, making it difficult for surging to occur. However, depending on the position where this projection 108 is to be provided or the shape thereof, detailed experiments become necessary and there was a possibility of reduced discharge flow rate in some cases.

Example 3 of the conventional cross flow fan:

As shown in FIG. 15, the conventional fan is provided with a suction opening 202 for taking in the open air at the front of the casing 201, a discharge opening 203 is provided thereunder, and a fan 204 is freely rotatably on a portion surrounded by a partition board 205 and a rear guider 201' in the air duct connected to the blow off opening 203 from the aforementioned suction opening 202.

The partition board 205 provided between the aforementioned suction opening 202 and the discharge opening 203 is intended to eliminate the short-circuit flow between the two openings and a blind patch is used for this purpose.

In addition, in the above example of the conventional cross flow fan, when the fan 204 is rotated in the direction indicated by the arrow, the air flow "a" is generated and sent out from the discharge opening 203. In this case, eccentric eddy "b" having its center inside the fan is generated in a portion where the partition board 205 and the fan 204 are close to each other, so that turbulent flow "c" is generated to flow around the eccentric eddy "b" and to cause pulsating current to be generated in the discharge air flow or to reduce the discharge air volume.

The magnitude and position of the eddy of accessory current generated secondarily depend on the shape and installed position of the partition board 205 and the number of revolutions of the fan and other factors. In order to maintain these factors under stabilized conditions, the eccentric eddy is stabilized at a fixed position by adjusting the number of revolutions of the fan so that the discharge air flow without pulsation can be obtained.

In such a case as above, it was extremely difficult to find an optimum shape and position for the partition board 205 according to the number of revolutions of the fan 204 and the load on the suction side.

Example 4 of the conventional cross flow fan:

As shown in FIG. 18(*a*) and FIG. 18(*b*), in the construction of the cross flow fan used conventionally for air conditioners and the like, an air flow direction control blade 305*a* is provided at the discharge opening formed between the rear guide 302 enclosing the fan 301 and the stabilizer 303 of the front panel 304. The control blade 305*a* is a flat board-like blade which does not curve in either direction. When an upward air discharge flow is desired, the air flow direction control blade 305*a* is maintained almost horizontally as shown in FIG. 18(*a*). Therefore, because a large space is formed between the inward upper surface of the air flow direction control blade 305*a* and the upward piece 303' in this case, the air flow "b" such as cold air or hot air is obtained from the discharge opening between the lower surface of the air flow direction control blade 305*a* and the extended upper surface of the rear guide 302 while the eddy like air flow "a'" is being generated in this space. In addition, when downward air flow is desired and the aforementioned air flow direction control blade 305*a* is set vertically as shown in FIG. 18(*b*), the air flow "b'1" generated above the circumference of the fan 301 collides with the air flow direction control blade 305*a* almost at a right angle because the air flow direction control blade 305*a* is flat. The air flow "b'1" is then blown downward by the internal pressure which is increases after collision.

In this case, as is apparent from the constructions shown in FIG. 18(*a*) and FIG. 18(*b*), when the air flow direction control blade 305*a* is set horizontally, the space formed by the aforementioned air flow direction control blade 305*a* and the upward pieces 303' of the stabilizer 303 becomes wider causing stagnation. Therefore, there is a possibility that sufficient air volume cannot be obtained at the discharge opening. Furthermore, when the aforementioned air flow direction control blade 305*a* is set vertically, the air flowing along the rear guide 302 collides with the aforementioned air flow direction control blade 305*a* almost at right angle. This collision causes the force for pushing the air flow downward to be diminished, and therefore there is also a possibility in this case that sufficient air volume cannot be obtained and that this arrangement is not effective.

SUMMARY OF THE INVENTION

It is an object of the present invention to solve the above mentioned conventional problems.

With respect to the example 1 of the conventional cross flow fan, the cross flow fan according to the present invention is provided with a flow changing board over the entire axial direction above the portion where the rear guider and the outward circumferential surface of the fan are closest to each other.

With respect to the example 2 of the conventional cross flow fan, the cross flow fan according to the present invention is composed so that the shape of the tongue section in close vicinity to the outward circumferential surface of the fan is caused to be different at both ends of the fan and at the middle section of the fan.

With respect to the example 3 of the conventional cross flow fan, the cross flow fan according to the present invention is provided with a partition board for short-circuiting which has continuous through holes at a position on the outward circumferential surface of the fan where the suction opening and the discharge opening of the air are separated.

With respect to the example 4 of the conventional cross flow fan, the cross flow fan according to the present invention is provided with an air flow direction control blade which is curved in one direction and mounted freely pivotably at the discharge opening section formed between the rear guide enveloping the fan and the stabilizer of the front panel.

In the first, above-described invention, because the air current which flows in without flowing through the fan from the neighboring section of the rear guider and fan is restricted and the air current flowing into the cross flow fan is increased, it is possible to increase the discharged air volume.

In the second, above-described invention, by composing the shape of the tongue section in close vicinity to the outward circumferential surface of the fan to be different at the middle section and at both ends of the axial direction of the fan, it is possible to improve the instability of the air flow at both ends of the discharge opening and to increase the flow rate.

In the third, above-described invention, the air flow is generated from the suction opening to the discharge opening by rotation of the fan, and by causing a part of the air flow sent out from the discharge opening to flow back from the secondary side to the primary side of the aforementioned partition board by means of the through hole thereof, the position of the eccentric eddy is caused to be fixed by the short-circuit flow.

In the fourth, above-described invention, when the direction of the air flow direction control blade is changed, by reducing the corner space formed by the stabilizer and by the curve of the aforementioned air flow direction control blade, a reduction in the air flow stagnation and an increase in the discharge air volumes results.

As has been described for the first embodiment, according to the present invention, by the flow changing board provided above the portion where the rear guider and outward circumferential surface of the fan are closest to each other, it is possible to increase the air flow which flows through the cross flow fan and to provide an excellent effect for increasing the discharged air volume.

As have been described for the second embodiment, according to the present invention, it is possible to increase the discharge flow rate at both ends of the fan and to also achieve stabilization of the discharged air flow at these ends of the fan. In addition, considerable effect is achieved to improve, for example, the overall instability of the discharged air flow in the low air volume range when a load such as a heat exchanger is provided on the suction side of the fan.

The third invention is an embodiment of high practical value, which has an excellent effect such as, for example, to stabilize the eccentric eddy at a fixed position without being moved by factors such as changes in the number of revolutions and the fluctuation of the load at the suction opening of the fan and to cause the discharged air volume to increase by means of a simple construction because the cross flow fan of the present invention is composed in a manner as described above.

Because the fourth embodiment is composed in a manner as described above, by using a air flow direction control blade of simple construction, it is possible to reduce the eddy current and to discharge the air at high efficiency when the aforementioned air flow direction control blade is held horizontally.

In addition, when the air flow direction control blade is set vertically, the cross flow fan of the present invention is capable of reducing the resistance of the air flow at the discharge section so as to achieve efficient air blowing and to reduce the thickness of the cross flow fan because of simple construction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinunder and the accompanying drawings which are given by way of illustration only, and thus are not limitative of the present invention and wherein:

FIG. 18(*b*) is a longitudinal sectional diagram showing the operation of the conventional apparatus.

DESCRIPTION OF THE PREFERRED EMBODIMENT

Figure 4:
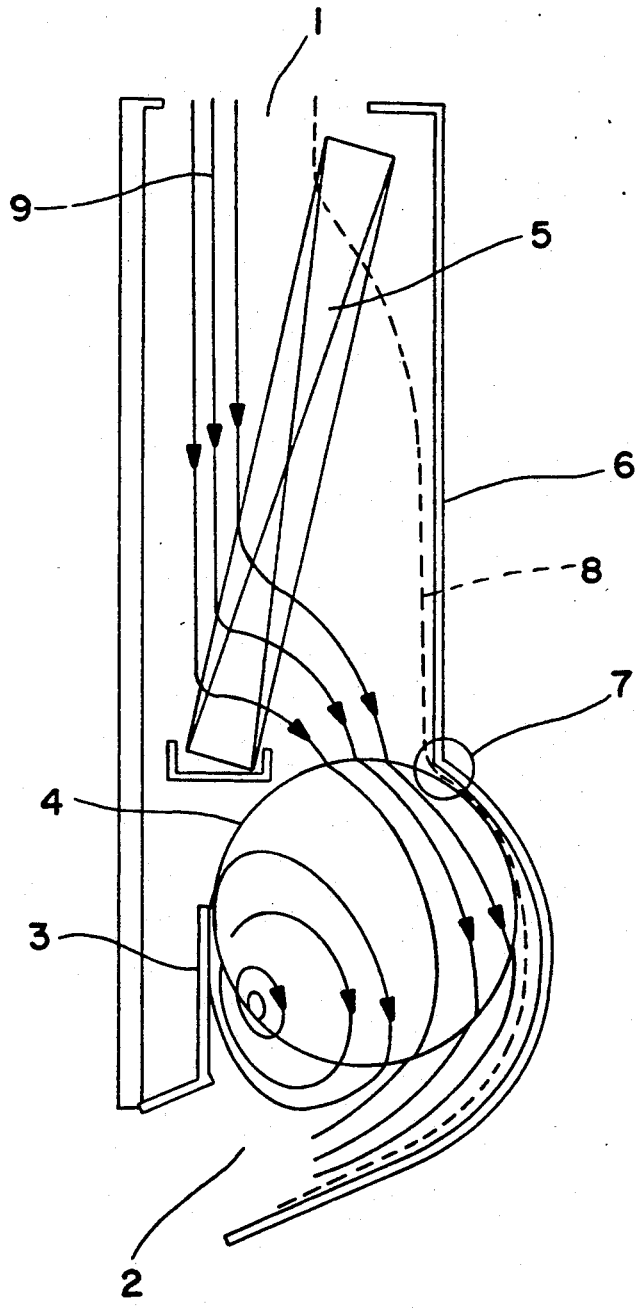
FIG. 4 is a structural diagram of a conventional cross flow type fan.

The first invention is accomplished in order to solve the problems of the example 1 set forth above for conventional cross flow fan and will hereafter be described with reference to the embodiment shown in FIG. 1. The same symbols in FIG. 1 as those used in FIG. 4 denote the same contents and therefore the descriptions thereof will now be omitted. That is to say, in this embodiment, a flow changing board 10 is provided over the entire axial direction of the fan above the portion 7 where the rear guider 6 and the outward circumferential surface of the fan are closest to each other.

By providing the construction of above, the air current which flows in without flowing through the cross flow fan from the part 7 is restricted as shown by the streamline 8' and the air current flowing into the cross flow fan 4 increases. Therefore, it becomes possible to increase the discharged air volume.

The cross flow fan 4 is rotated to suck the air into the body 1 from the suction opening 1. The air sucked into the body 1 gives and receives heat energy with the heat medium in the heat exchanger 5 while the air passes through the heat exchanger 5 and the air is further subjected to the driving action of the cross flow fan 4 to be discharged from the discharge opening 2. While the air is being discharged, the air current 8' flowing along the rear guider 6 in the casing collides with the flow changing board 10 to move toward the center of the casing, and then flows through the cross flow fan 4.

Figure 1:
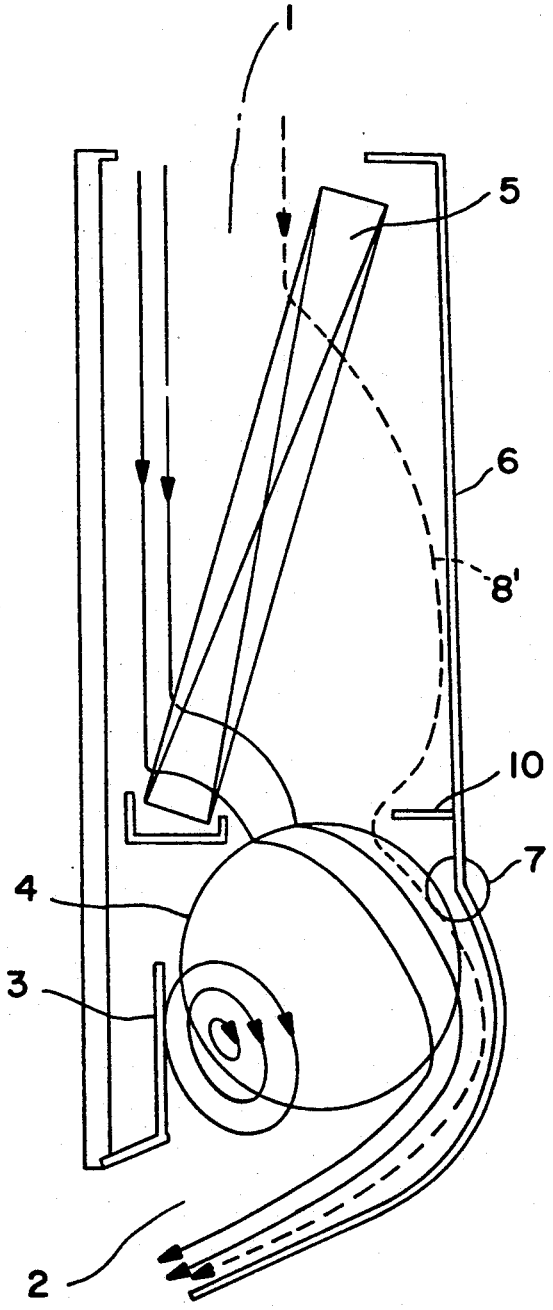
FIG. 1 is a structural diagram of a cross flow type fan showing an embodiment of the present invention.
Figure 2:
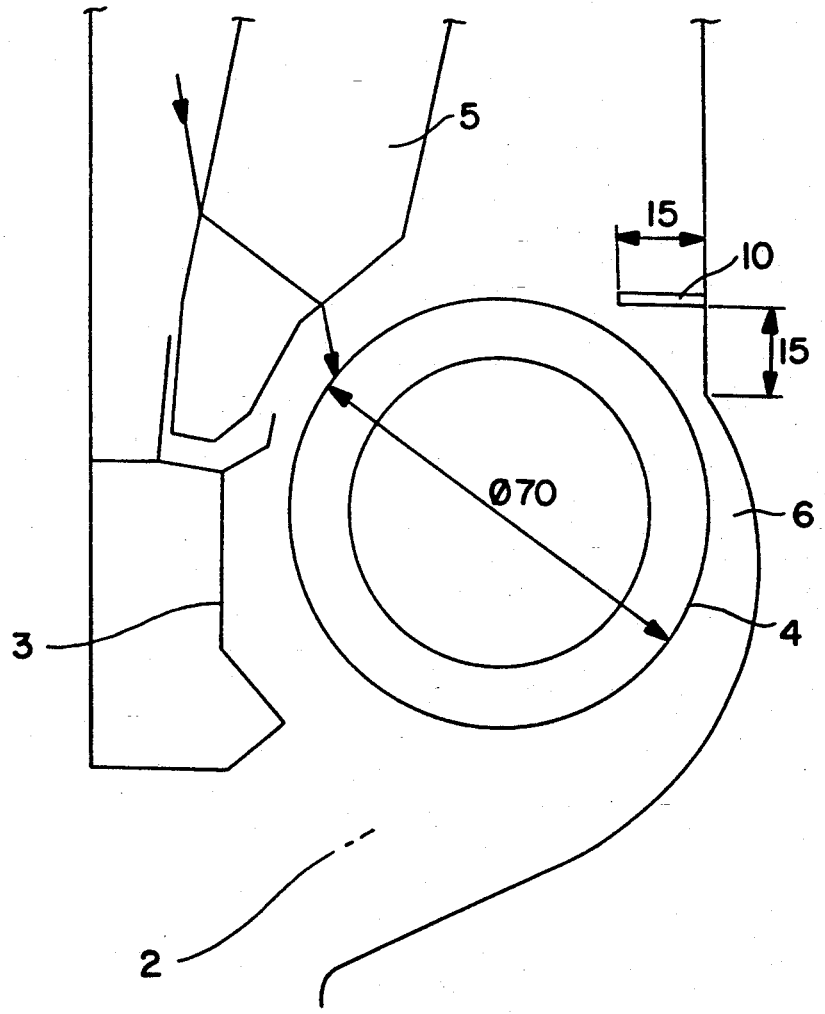
FIG. 2 is a detailed diagram of the essential components of FIG. 1.

FIG. 2 is a detailed diagram of the cross flow type fan shown in FIG. 1 which is used to confirm the effect of the above embodiment through experiments and is provided with a flow changing board 10 having a width of 15 mm with respect to the diameter of 70 mm of the cross flow fan 4.

Figure 3:
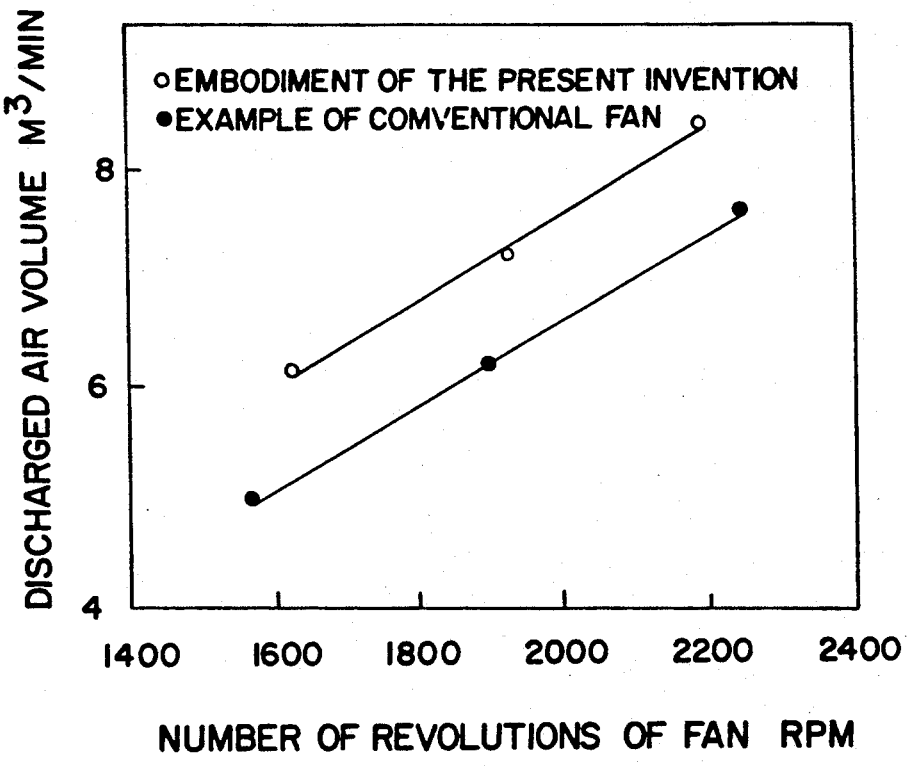
FIG. 3 is an explanatory diagram showing experimental results wherein the cross flow type fan shown in FIG. 2 is used.

FIG. 3 shows an example of the test results illustrating a relation between the number of revolutions and the air volume.

From FIG. 3, the effect of this embodiment is shown as an increase in the air volume of about 1 $m^3$/min for the same number of revolutions.

According to the present invention as described above, it is possible to increase the discharged air volume of a cross flow type fan by means of an extremely simple construction, and the industrial effect thereof is very large.

Figure 5:
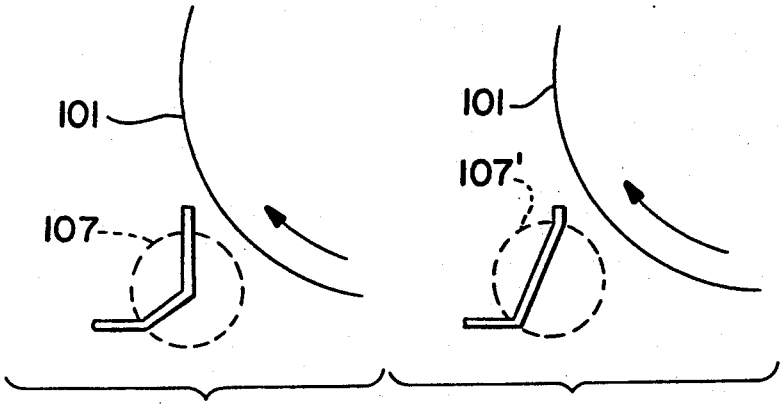
FIG. 5(1) and FIG. 5(2) are diagrams showing the shape of the tongue section in an embodiment of the present invention, FIG. 5(1) shows the shape of the tongue section in the middle section in the axial direction of the fan and FIG. 5(2) shows the shape of the tongue section at both ends in the axial direction of the fan.
Figure 6:
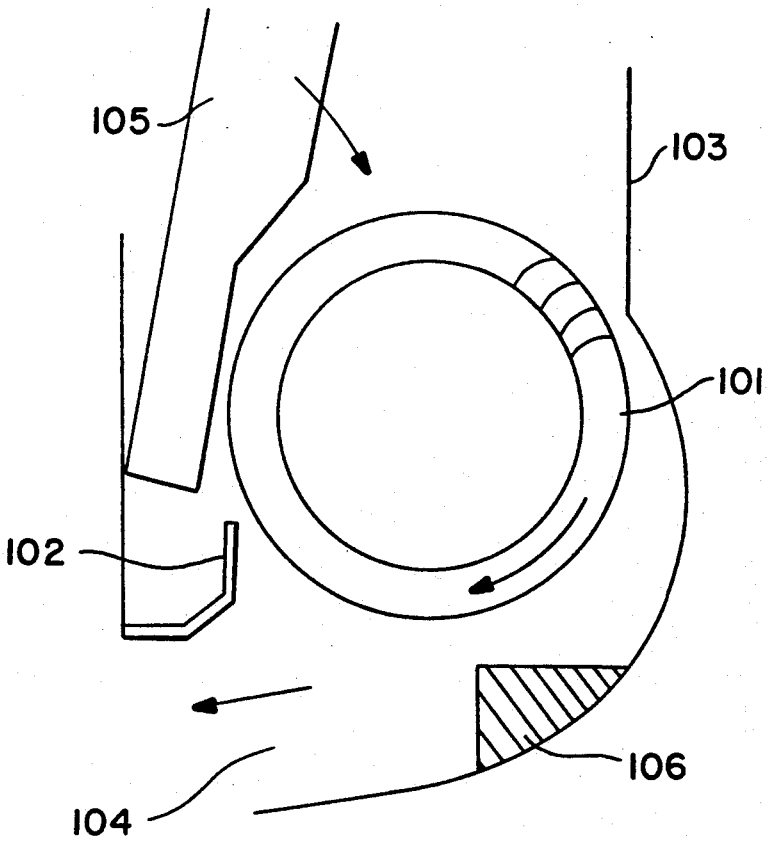
FIG. 6 is a cross sectional structural diagram of the cross flow type fan for a conventional air conditioner.
Figure 7:
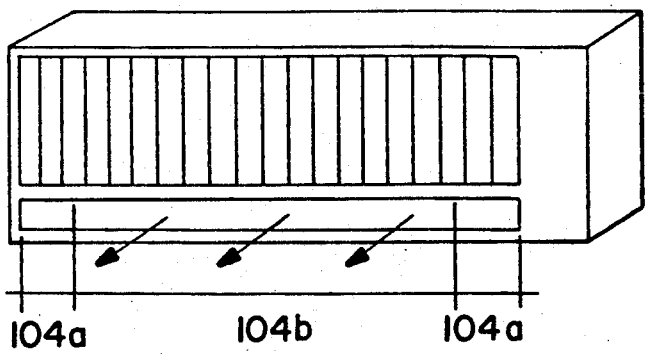
FIG. 7 is a perspective diagram showing the discharge opening section of an air conditioner.

For the shape of the tongue section of the example 2 of the conventional cross flow fan, the one shown in FIG. 5(1) is common and is designed so as to obtain high air volume. As compared with the shape of the tongue section of FIG. 5(1), FIG. 5(2) shows the shape of the tongue section whose space with the outward circumferential surface of the fan is widened by tilting (107') the portion of the tongue section (tip of the tongue section) 107 in close vicinity of the outward circumferential surface of the fan so as to move away from the outward circumferential surface of the fan than the portion 107 shown in FIG. 5(1).

Figure 8:
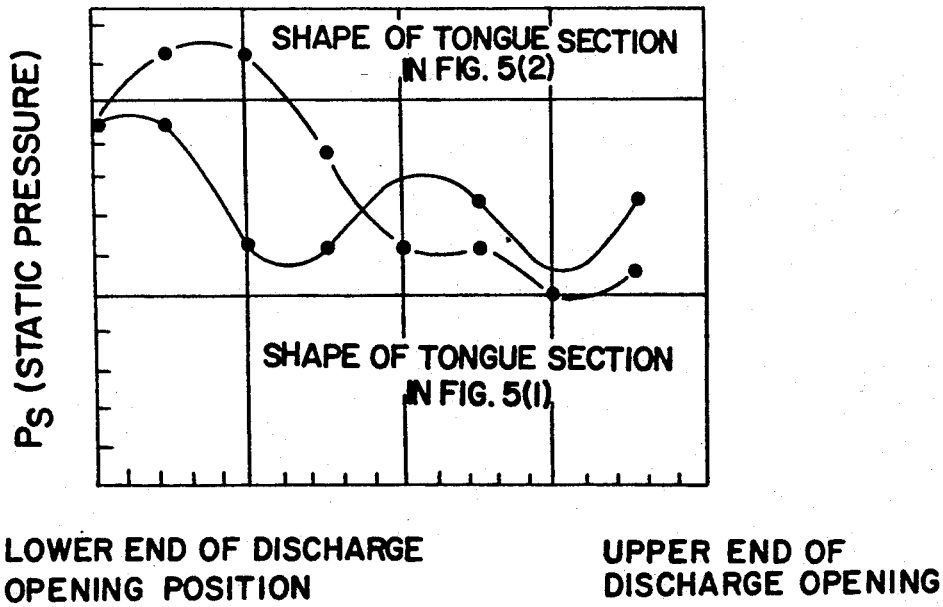
FIG. 8 is a diagram showing experimental results of the static pressure distribution of the discharged air flow in case when the tongue section of FIG. 5(1) and FIG. 5(2) are used.

With regard to the shape of the tongue section shown in FIG. 5(1) and FIG. 5(2) respectively. FIG. 3 shows a comparison of experimental results for the static pressure distribution at the discharge opening 4. From the results shown in FIG. 8, it is known that the shape of the tongue section shown in FIG. 5(2) has higher static pressure distribution than that shown in FIG. 5(1).

In the second invention, the shape of the tongue section shown in FIG. 5(2) is provided at both ends 104*a* of the fan, the entire tongue section is composed in the middle section 104*b* by using the shape of the tongue section shown in FIG. 5(1), and by increasing the static pressure of the discharged air flow at both ends 104*a* of the discharge opening higher than that at the middle section 104*b*, the pressure characteristic of the discharged air flow at both ends 104*a* is improved so as to obtain better stability.

Figure 9:
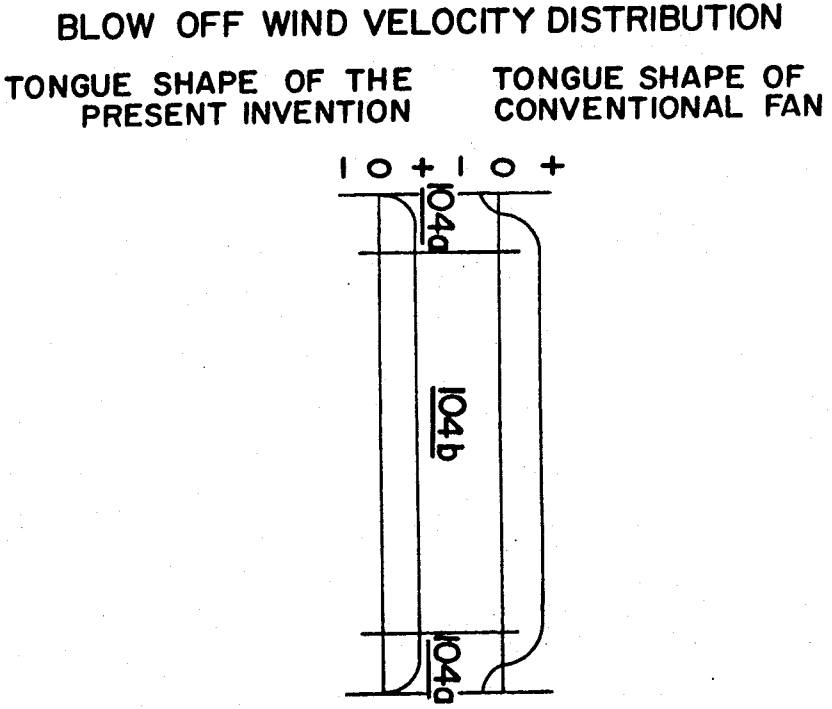
FIG. 9 is a diagram for comparing the wind velocity distribution in the axial direction of the fan between a case wherein the tongue section according to the present invention is used and a case wherein the conventional tongue section is used.

FIG. 9 is a diagram in which the wind velocity distribution of the discharged air flow in the axial direction of the fan is compared between the case where the tongue section according to the present invention is used and the case of the tongue section of the conventional cross flow fan, and it is known that the flow rate at both ends 104*a* of the present invention is increased.

As described above, according to the present invention, it is possible to improve the instability of the air flow at both ends 104*a* of the discharge opening which has conventionally been a problem. In addition, a considerable improvement for example the overall instability of the discharged air flow in the low air volume range is obtained when a load such as a heat exchanger is provided on the suction side of the fan.

Figure 10:
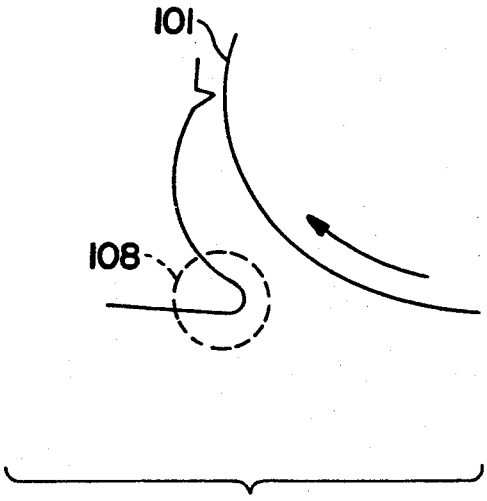
FIG. 10(1) and FIG. 10(2) are diagrams respectively showing the shape of the tongue section at the middle section and at both ends in the axial direction of the fan in an embodiment of the present invention.
Figure 10:
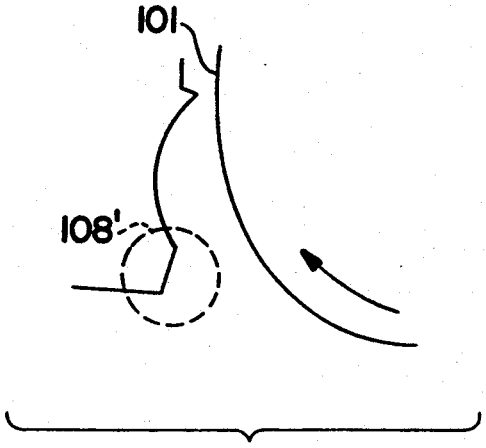

As a transformed embodiment of the present invention, in the case of the circular arc tongue section as shown in FIG. 10(1), the same effect can be obtained by providing at both ends 104*a* the tongue section which is tilted in the shape 108' so as to move the tip 108 of the tongue section shown in FIG. 10(1) from the outward circumferential surface of the fan as shown in FIG. 10(2).

Figure 11:
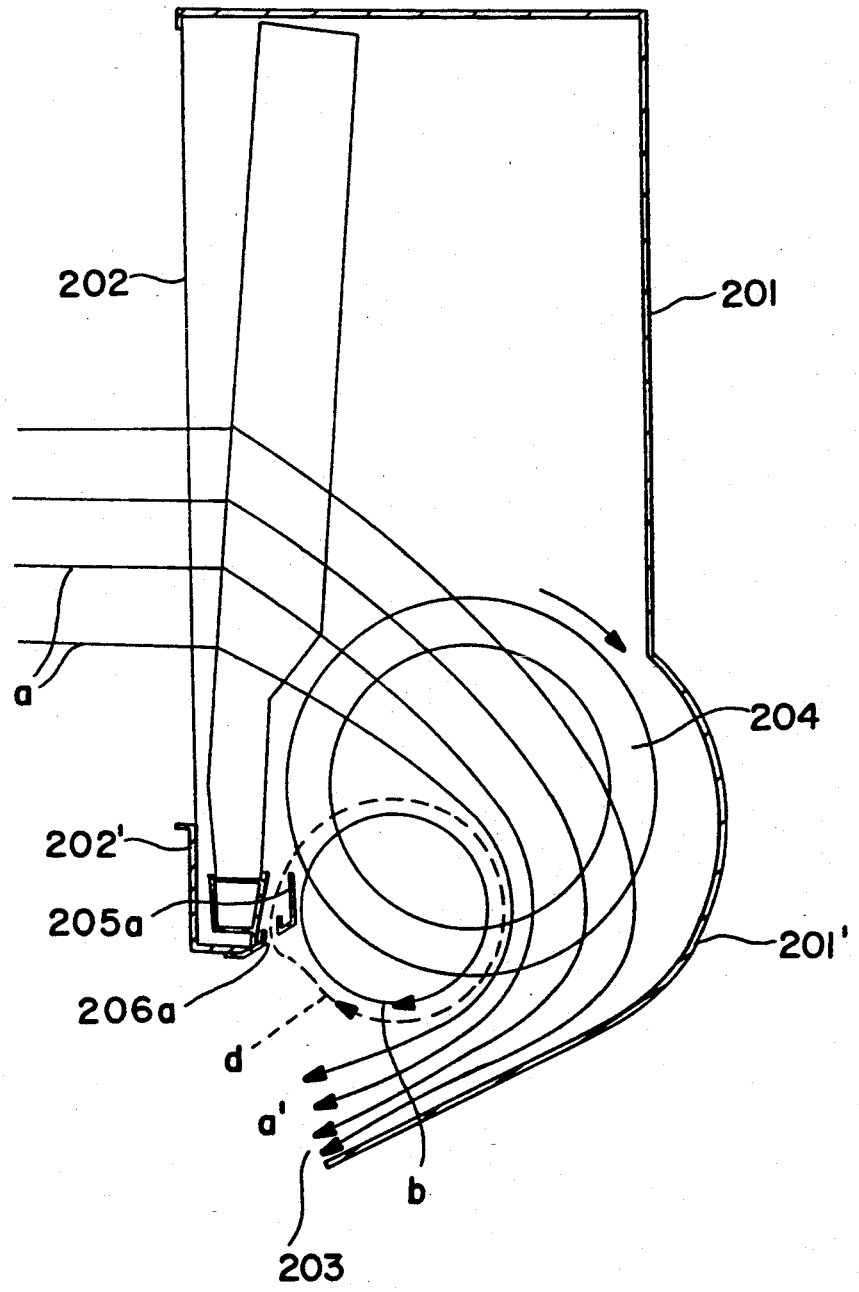
FIG. 11 is a schematic diagram of the vertical side of the apparatus according to the present invention.
Figure 12A:
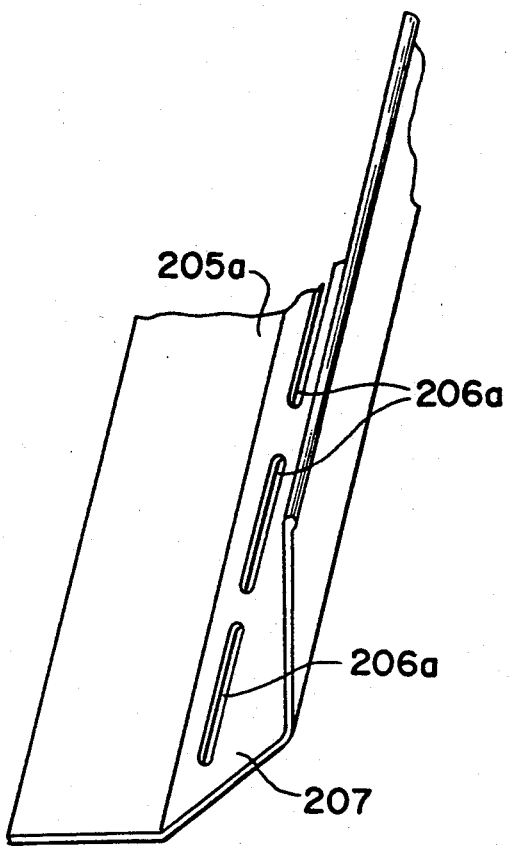
FIG. 12(*a*) and FIG. 12(*b*) are enlarged perspective diagrams respectively of essential components.
Figure 12B:
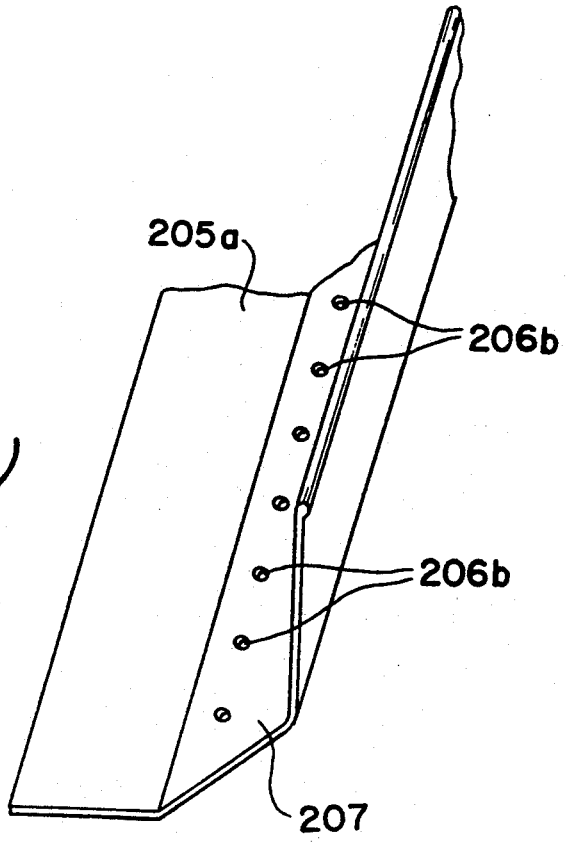

The third invention will be described in detail by the embodiment shown in FIG. 11. The suction opening 202 for taking in the open air is provided at the front section of the casing 201 of the fan as shown in FIG. 11, the discharge opening 203 is formed thereunder, the fan 204 is freely rotatably at a portion surrounded by the lower edge 202' of the suction opening and the rear guider 201' in the air duct connected from the aforementioned suction opening 202 to the discharge opening 203. In the corner section between the aforementioned fan 204 and the aforementioned lower edge 202' of the suction opening and on the aforementioned lower edge 202' of the suction opening, the partition board is formed with continuous through holes 206*a*, 206*a* . . . comprising one or a plurality of slots which are fixed as shown in FIG. 12(*a*). The short circuit flow is, therefore caused to be generated between the suction side, that is the primary side and the discharge opening, that is, the secondary side.

Furthermore, the aforementioned continuous through holes 206*a*, 206*b* . . . are provided on the plane 207 forme on the partition board 205*a* so as to intersect almost a right angle with the outward circumferential surface of the fan 204. In addition to the aforementioned continuous through hole 206*a*, circular continuous through holes 206*b*, 206*b*, . . . may be drilled as shown in FIG. 12(*b*).

The operation of the aforementioned fan will be described.

When the fan 204 is rotated in the direction of the arrow, the air current "a" sucked in from the suction opening 202 is blown off from the discharge opening 203 as the air current "a". And, by the rotation of the fan 204, the eccentric eddy "b" is generated by the influence of the intersecting section formed by the aforementioned partition board 205*a* and the aforementioned fan 204. While the eccentric eddy "b" is being generated, the outer layer thereof collides with the plane 207 of the partition board 205*a* and tries to flow outward through the discharge opening 203, but because of the existence of the aforementioned continuous through hole 206*a* or 206*b*, a part of the air current on the secondary side blows back to the primary side to form the stabilized short circuit flow "d". Because the eccentric eddy "b" is retained at a fixed position by the stabilized short circuit flow "d" formed in the primary side, the influence upon the main air current "a" by the fluctuation of the aforementioned eccentric eddy will be eliminated.

Figure 13:
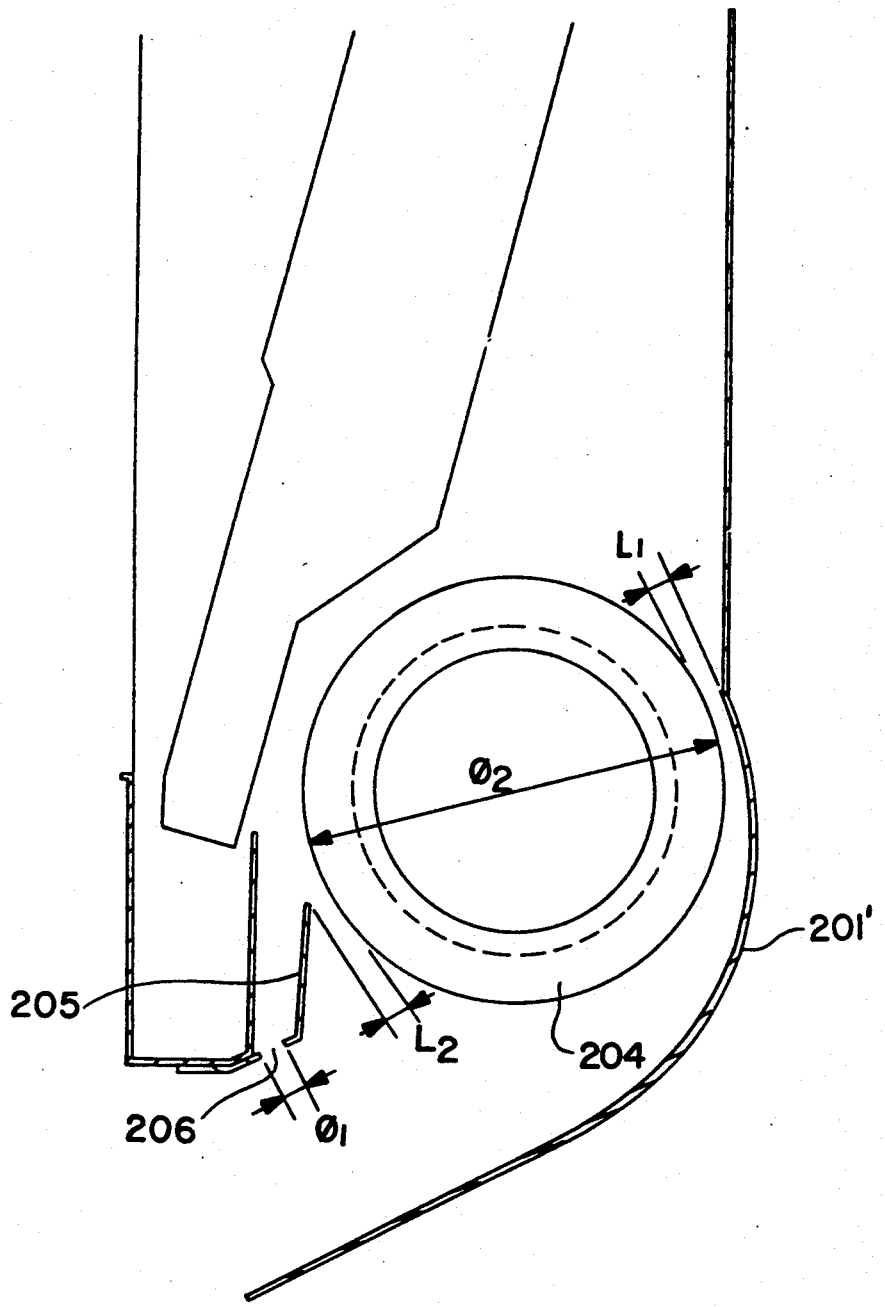
FIG. 13 is a schematic diagram of the vertical side of an apparatus for testing.
Figure 14:
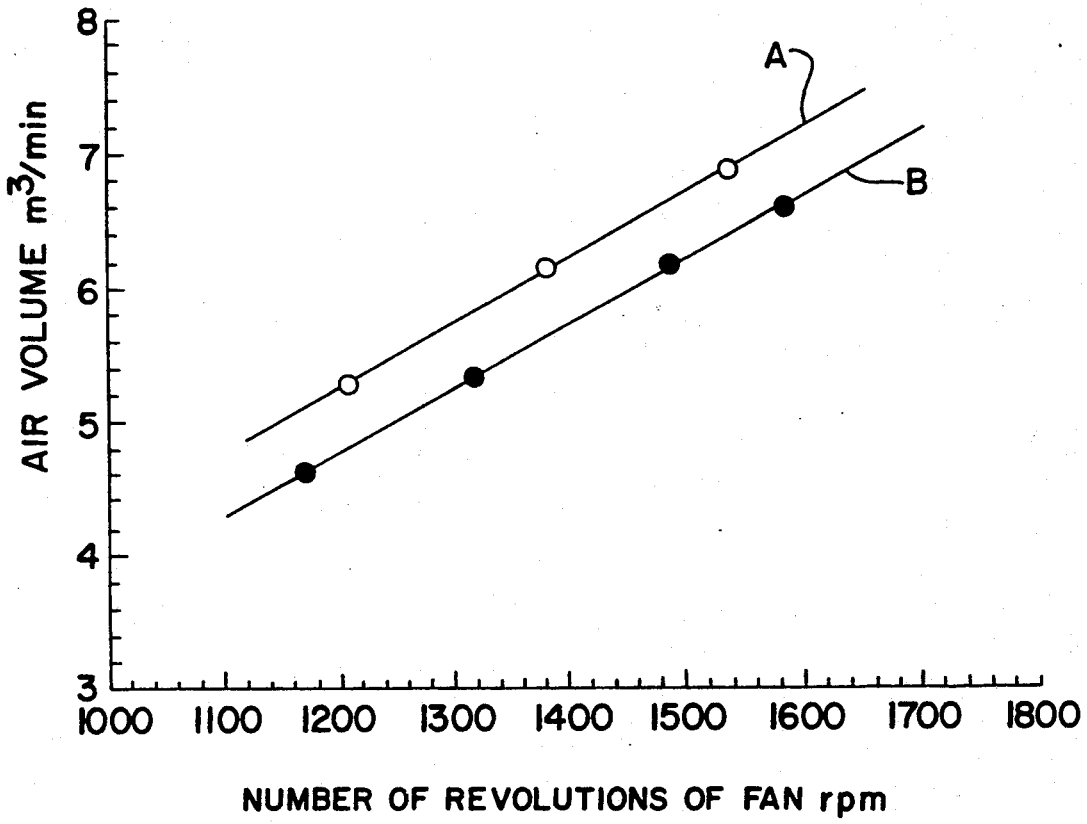
FIG. 14 is a diagram for comparing the performance between the apparatus of the present invention and the conventional apparatus.
Figure 15:
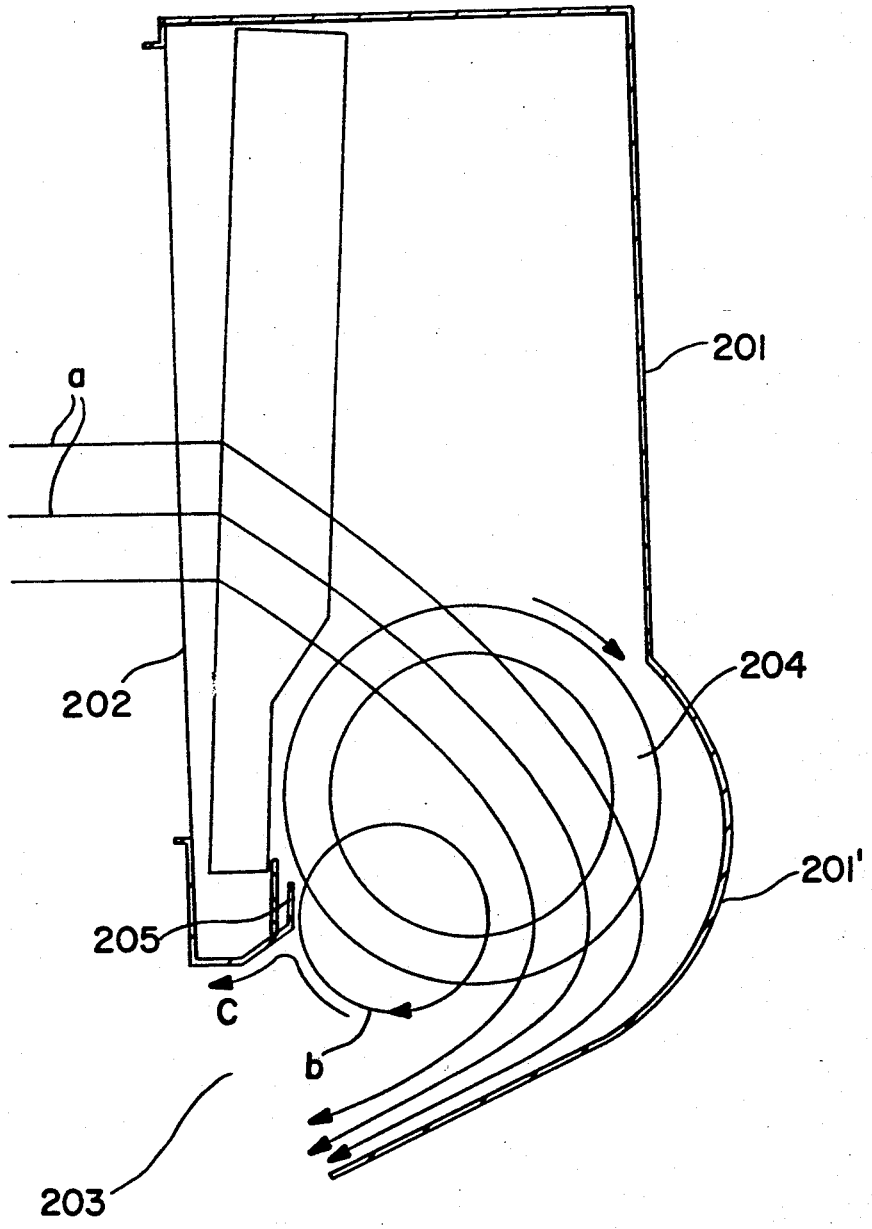
FIG. 15 is a schematic diagram of the vertical side showing the conventional apparatus.
Figure 16:
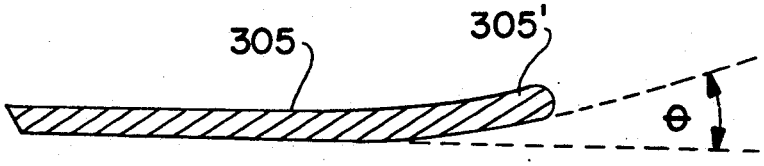
FIG. 16 is a longitudinal sectional diagram of the air flow direction control blade of the present invention.

FIG. 14 (where A represents the case of FIG. 13 and B the case of FIG. 15) shows that characteristics of the number of revolutions versus the air volume of the fan 204 of the cross flow fan used for testing shown in FIG. 13, in which the diameter of the continuous through hole 206*b* is $\phi 1=4$ mm, the distance between the fan 204 and the inner edge of the partition board 205*b* is $L_2=7$ mm, the diameter of the aforementioned fan 204 is $\phi 2=70$ mm, and the distance between the fan 204 and the rear guider 201' is $L_1=4$ mm. In the case of the present invention, however, as compared with the conventional cross flow fan, more discharge air volume is obtained per the same number of revolutions by about 0.5 $m^3$/min, and further a stabilized proportional characteristic is demonstrated with respect to the number of revolutions of the fan.

In the above, the length of the continuous hole 206*a* or the diameter and the number and other factors of the circular continuous hole 206*b* are not limitative of the above embodiment.

Figure 17A:
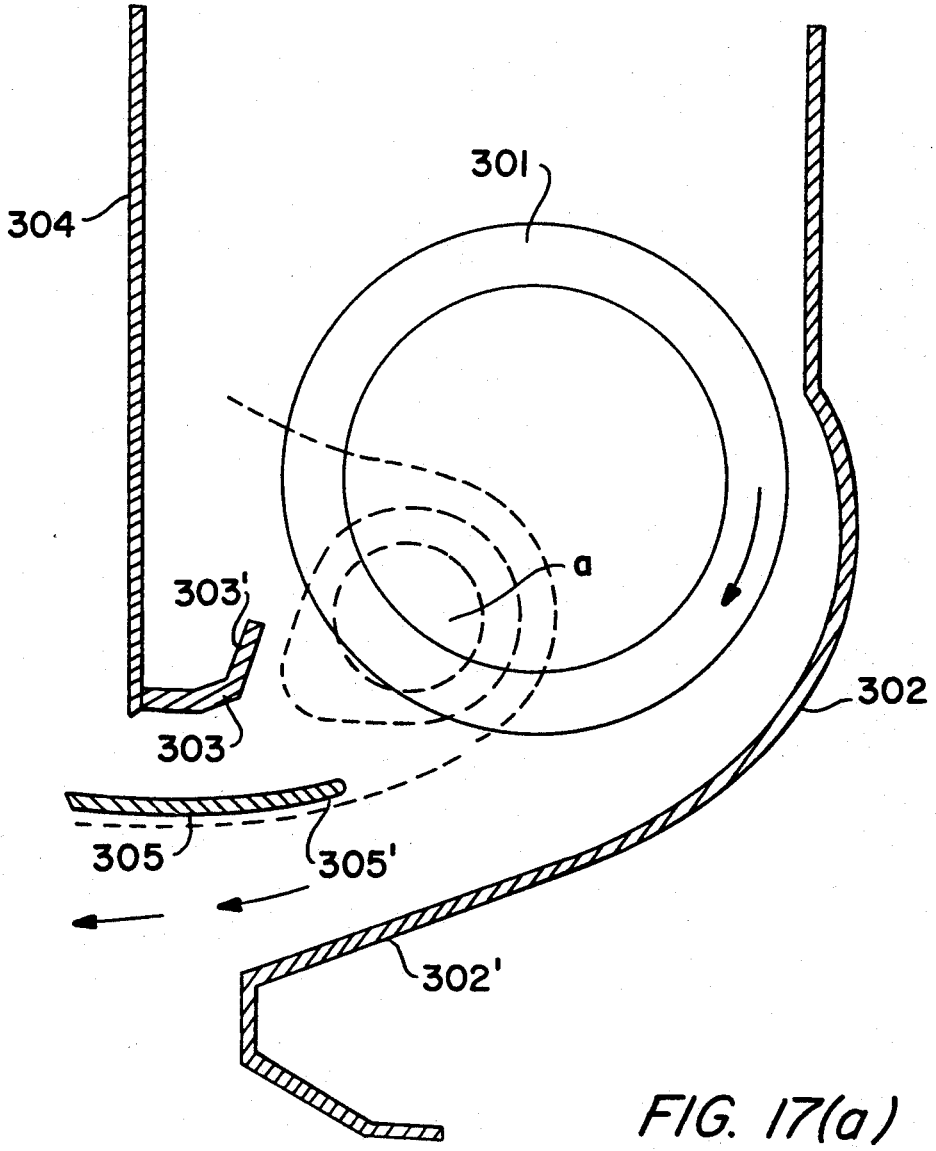
FIG. 17(*a*) is a longitudinal sectional diagram showing an example of usage of the air flow direction control blade of another embodiment, FIG. 17(*b*) is a longitudinal sectional diagram showing the operation of the blade of the embodiment Fig.
Figure 17B:
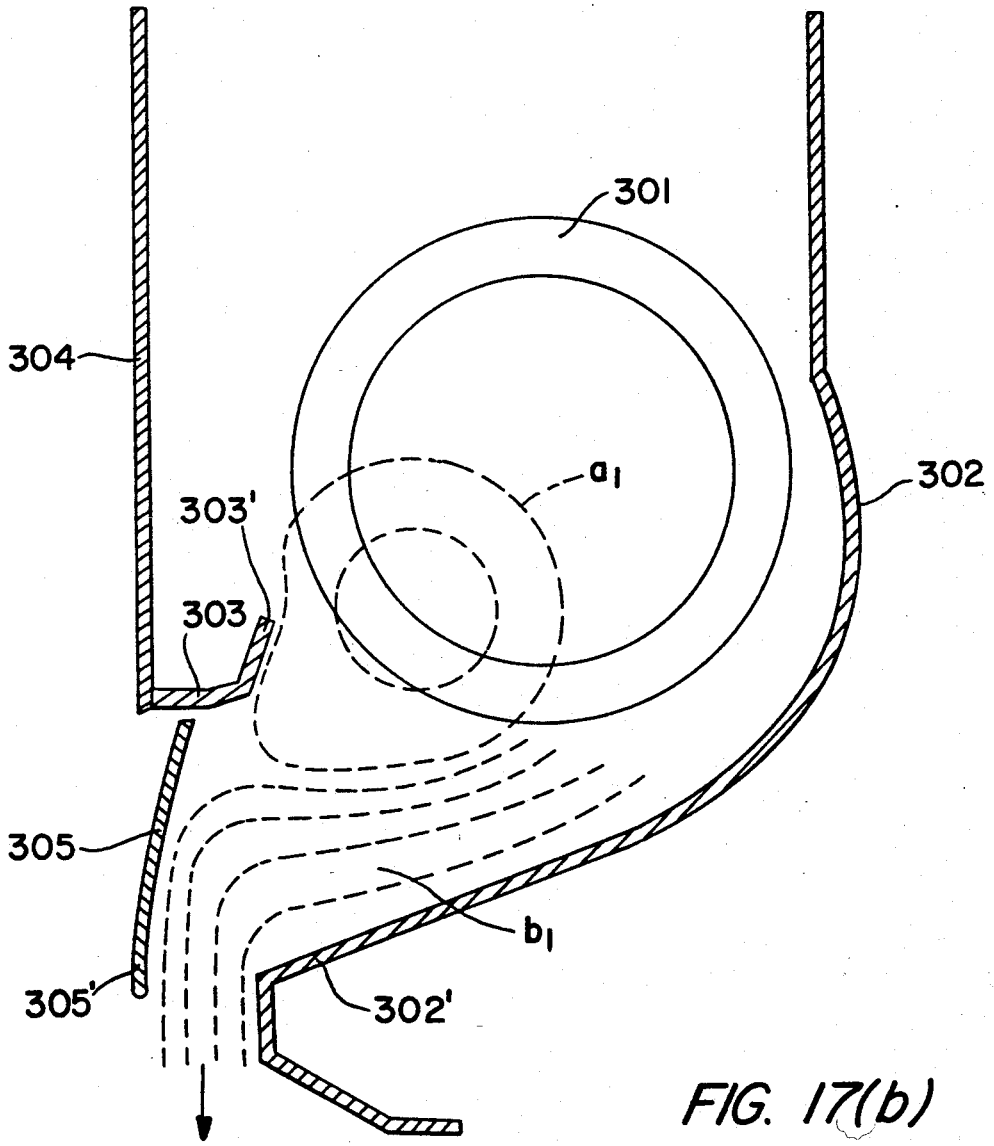

With respect to the fourth embodiment, as shown in FIG. 17, a discharge opening such as for example, for warm or cool air is formed between the rear guide 302 surrounding the fan 301 and the stabilizer 303 of the front panel 304, and between the stabilizer and the frontal section 302' of the rear guide 302 the air flow direction control blade 305. One end section 305' of the blade 305 is curved upwardly (15' in this case) and the blade 305 is installed to be held horizontally or vertically.

That is to say, the most essential point of the present invention is that when the air flow direction control blade 305 is held horizontally, the direction of the curve and inclination of the blade 305 is such that the tip 305' thereof is caused to curve on the circumference of the fan 301 in a direction directly facing the rotational direction of the fan 301 and that when the end section 305' of the air flow direction control blade 305 is held vertically, the other end section is composed to curve inward from the outer surface of the front panel 304 so as to extend toward the direction of the stabilizer 303.

Figure 18A:
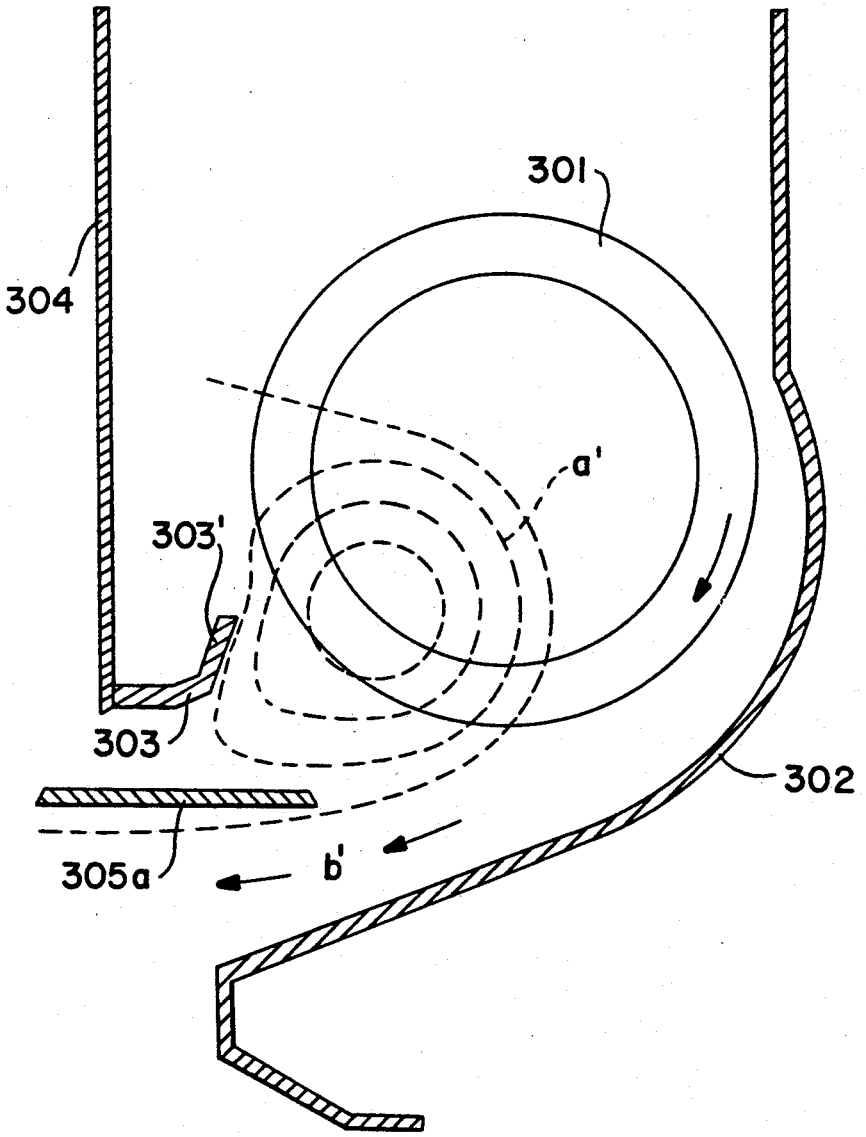
FIG. 18(*a*) is a longitudinal sectional diagram of the conventional apparatus.
Figure 18B:
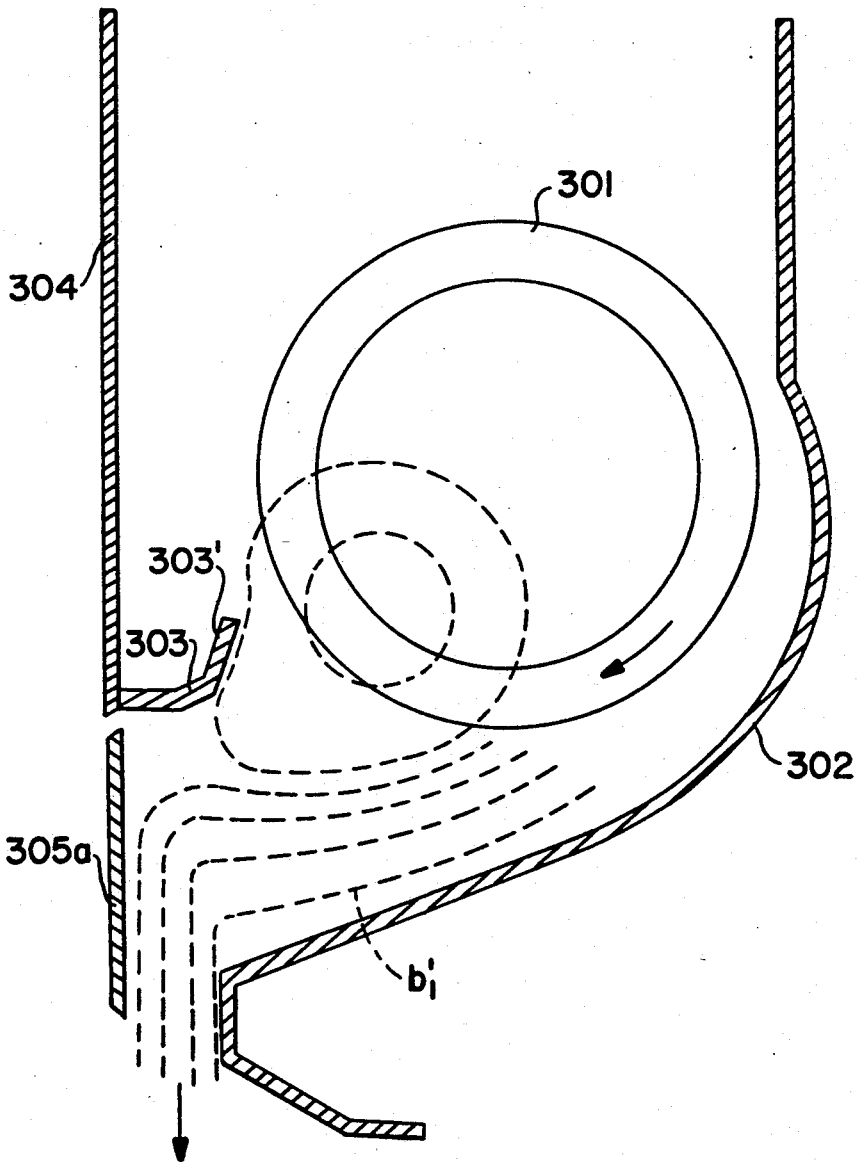

Now, the operation of the air flow direction control blade of the present invention according to the above construction will be described. When the air flow direction is to be directed upward, because the end section 305' of the air flow direction control blade 305 and a part of the corner of the upward piece 303' of the stabilized 303 is reduced by the curve of the end section 305' and the air current stagnation is reduced as a result of setting the air flow direction control blade 305 horizontally as shown in FIG. 18(*a*), the scale of the eddy current "a" caused by the stagnation is reduced and it becomes possible to obtain sufficient air current "b" from the discharge opening formed between the air flow direction control blade 305 and the tip section 302' of the rear guide 302.

Furthermore, when the air flow direction is to be directed downward, by directing vertically the end section 305' of the air flow direction control blade 305 as shown in FIG. 17(*b*), the air current "$b_1$" generated by the fan 301 blows strongly along the tip section 302' of the rear guide 302 and the upper part of the air flow direction control blade 305 is inclined inwardly from the front surface of the front panel 304. Therefore, because the end section 305' of the air flow direction control blade 305 does not intersects with the air current "$b_1$" at a right angle and becomes inclined toward the direction of the discharge opening, thereby reducing the flow resistance and the scale of the eddy current "$a_1$".

The present invention is designed to smooth the air current in a manner as described above by providing a curve at the tip of the air flow direction control blade and to prevent stagnation of the air flow.

While only certain embodiments of the present invention have been described, it will be apparent to those skilled in the art that various changes and modifications may be made therein without departing from the spirit and scope of the present invention as claimed.

What is claimed is:

1. A cross flow type fan having a tongue section provided between a rear guide surrounding a cross flow fan, a back side and bottom side thereof and a front side of the fan, at a discharge opening section formed by a stabilizer of the front panel and the rear guide surrounding the cross flow fan an air flow direction control blade being provided, the air flow direction control blade being rotatably disposed and having opposed sides with one side being curved and one side being concave such that the air flow direction control blade is curved in one direction, the concave side of the air flow direction control blade facing the cross flow fan when the air flow direction control blade is rotated to a generally vertical position.

2. The cross flow type fan according to claim 1, wherein the curved side of the air flow direction control blade is positioned on an air discharge side of the cross flow fan when the blade is rotated to a generally horizontal position and the curved portion is positioned on a lower side of the blade when the blade is rotated to the generally vertical position.

3. The cross flow type fan according to claim 2, wherein the concave side of the air flow direction control blade is positioned on a side facing the cross flow fan when the blade is rotated to the generally vertical position and the curved portion is then located on a lower side of the blade.

4. The cross flow type fan according to claim 1, wherein the concave side of the air flow direction control blade is positioned on an upper side of the blade and the curved side is positioned on a lower side of the blade when the blade is in a generally horizontal position.

5. The cross flow type fan according to claim 4, wherein the concave side of the air flow direction control blade is positioned on a side of the blade facing the cross flow fan when the blade is in the generally vertical position.

6. The cross flow type fan according to claim 5, wherein the curved portion is located on a lower side of the blade when the blade is in the generally vertical position.

7. The cross flow type fan according to claim 6, wherein the curved portion is located on a side of the blade facing the cross flow fan when the blade is in the generally horizontal position.

8. The cross flow type fan according to claim 7, wherein the blade has first and second ends, the curved portion being located on the first end of the blade and the second end of the blade being closer to the stabilizer than the first end when the blade is in the generally vertical position.

9. The cross flow type fan according to claim 1, wherein the blade has first and second ends, the curved portion being located on the first end of the blade and the second end of the blade being closer to the stabilizer than the first end when the blade is in the generally vertical position.

10. The cross flow type fan according to claim 1, wherein the blade has a generally bowed configuration with the concave side thereof facing downwardly when the blade is in a generally horizontal position.

11. A cross flow type fan comprising a tongue section, a rear guide, a cross flow fan, and a stabilizer, the tongue section being provided between the rear guide and a back side of the fan and a bottom of the fan, the rear guide surrounding the cross flow fan, a discharge opening being provided on a front panel of the fan by the stabilizer and the rear guide surrounding the cross flow fan, the cross flow type fan further comprising a rotatable air flow direction control blade adjacent the discharge opening, the air flow direction control blade having a generally uniform thickness with one end thereof forming a curved portion, the curved portion facing the cross flow fan when the blade is in a generally horizontal position, the blade being rotatable from the generally horizontal position to a generally vertical position.

12. The cross flow type fan according to claim 11, wherein the air flow direction control blade generally has a bowed configuration.

13. The cross flow type fan according to claim 12, wherein the air flow direction control blade has a concave side and a curved side, the concave side being above the curved side when the blade is in the generally horizontal position.

14. The cross flow type fan according to claim 13, wherein the concave side is closer to the cross flow fan than the curved side when the blade is in the generally vertical position.

15. The cross flow type fan according to claim 14, wherein the curved portion is located on a lower side of the blade when the blade is in the generally vertical position.

16. The cross flow type fan according to claim 11, wherein the air flow direction control blade has a concave side and a curved side and wherein the concave side is located above the curved side of the blade when the blade is in the generally horizontal position.

17. The cross flow type fan according to claim 16, wherein the concave side of the blade is closer to the cross flow fan than the curved side when the blade is in the generally vertical position.

18. The cross flow type fan according to claim 17, wherein the curved portion of the blade is on a lower side of the blade when the blade is in the generally vertical position and wherein the curved portion faces the cross flow fan when the blade is in the generally horizontal position.

19. The cross flow type fan according to claim 18, wherein the blade has first and second ends, the curved portion being located on the first end of the blade and the second end of the blade being closer to the stabilizer than the first end when the blade is in the generally vertical position.

20. The cross flow type fan according to claim 11, wherein the blade has first and second ends, the curved portion being located on the first end of the blade and the second end of the blade being closer to the stabilizer than the first end when the blade is in the generally vertical position.

* * * * *

UNITED STATES PATENT AND TRADEMARK OFFICE

CERTIFICATE OF CORRECTION

PATENT NO. : 5,197,850

DATED : March 30, 1993

INVENTOR(S) : Akira Takushima et al.

It is certified that error appears in the above-identified patent and that said Letters Patent is hereby corrected as shown below:

Column 9:

Claim 1, line 8 after "with" insert --a bend portion at the end,--

Signed and Sealed this

Twenty-first Day of December, 1993

*Attest:*

Bruce Lehman

BRUCE LEHMAN

*Attesting Officer*

*Commissioner of Patents and Trademarks*